US006923114B2

(12) United States Patent
Koch

(10) Patent No.: US 6,923,114 B2
(45) Date of Patent: Aug. 2, 2005

(54) CAN CRUSHER

(76) Inventor: Tim Koch, 13001 Ottawa Pl., Savage, MN (US) 55378

( * ) Notice: Subject to any disclaimer, the term of this patent is extended or adjusted under 35 U.S.C. 154(b) by 0 days.

(21) Appl. No.: 10/371,191

(22) Filed: Feb. 19, 2003

(65) Prior Publication Data

US 2003/0183096 A1 Oct. 2, 2003

Related U.S. Application Data

(60) Provisional application No. 60/357,910, filed on Feb. 19, 2002.

(51) Int. Cl.[7] ..... B30B 1/22; B30B 9/32

(52) U.S. Cl. ..... 100/98 R; 100/229 A; 100/240; 100/290; 100/902

(58) Field of Search ..... 100/49, 229 A, 100/274, 289, 290, 215, 345, 902, 98 R, 240, 214; 220/211, 260, 908

(56) References Cited

U.S. PATENT DOCUMENTS 578,857 A * 3/1897 Brown ..... 100/209
3,208,372 A * 9/1965 Taylor ..... 100/98 R
3,527,161 A * 9/1970 Brown ..... 100/256
3,756,150 A * 9/1973 Bourgeois ..... 100/229 A
3,838,635 A * 10/1974 Hardy ..... 100/215
3,868,903 A * 3/1975 Montalbano ..... 100/45
3,889,587 A * 6/1975 Wharton ..... 100/98 R
4,213,384 A * 7/1980 Telling ..... 100/74
5,103,721 A * 4/1992 Chou et al. ..... 100/37
5,188,022 A * 2/1993 Benson et al. ..... 100/52
5,213,031 A * 5/1993 Hebbert ..... 100/98 R

* cited by examiner

*Primary Examiner*—Allen Ostrager
*Assistant Examiner*—Jimmy Nguyen
(74) *Attorney, Agent, or Firm*—Schwegman, Lundberg, Woessner & Kluth, P.A.

(57) ABSTRACT

A compressing device is provided that is suitable for crushing cans. A compressing device is provided that includes a plurality of linear drive actuators located along side a compression chamber to both reduce height/size of the compressing device, and provide a more uniform compression force to the can. A compressing device is provided that includes a workpiece receptacle that collects liquid or other debris, increases the safety of the compressing device by shielding sharp edges of the crushed workpiece, and provides for easy cleaning due to it's removability and dishwasher safe construction. A compressing device is provided that includes crimping portions that provide more controlled easier crushing of work pieces such as aluminum cans.

17 Claims, 5 Drawing Sheets

CAN CRUSHER

RELATED APPLICATION

This application claims priority under 35 U.S.C. 119(e) from U.S. Provisional Application Ser. No. 60/357,910 filed Feb. 19, 2002, which application is incorporated herein by reference.

TECHNICAL FIELD

The following disclosure relates to metal crushing devices and methods. Specifically, the following disclosure relates to a device and method for crushing cans including, but not limited to, aluminum beverage cans.

BACKGROUND

Crushing metal objects such as cans before they are recycled dramatically reduces the volume of space necessary to store them prior to melting, etc. in the recycling process. One common example of crushing metal objects for storage prior to recycling is aluminum beverage cans. Although aluminum beverage cans are used as one example of a metal object for crushing, the invention is not so limited.

Every second, an estimated 1500 aluminum beverage cans are recycled in the United States. Nearly 2 of every 3 aluminum cans in the United States are recycled. Aluminum cans have been the number one recycled package container for 20 years. The aluminum can recycling industry has paid as much as $1.2 billion in one year to local economies benefiting individuals, churches, schools, troops, and other non-profit entities. Aluminum cans account for nearly all of the single-serve beverage container market. In their normal state, however, aluminum cans take up a large amount of space. They are commonly crushed to a more compact state prior to recycling so that they can be stored more efficiently.

To date, an affordable, durable, clean, and safe automatic crushing device has not been available to consumers in the mass market. Although some large and cumbersome commercial crushing devices exist, none offer a sufficiently compact size, ease of use, safety, automation, durability, or affordability. Crushing cans be difficult and dangerous for the young or the elderly, and can be burdensome or inconvenient for others. Stepping on cans to crush them can damage floors or cause a mess. Manual can crushers are unattractive, messy, and require a certain amount of strength to use.

What is needed is a device to crush metal objects such as aluminum cans that is compact, clean, safe, efficient, affordable, and easy to use.

SUMMARY

The above mentioned problems of size, cleanliness, safety, efficiency, price, and ease are addressed by the present invention and will be understood by reading and studying the following specification. Systems, devices and methods are provided for a metal crushing device. The systems, devices, and methods of the present invention offer a compact design that is clean, safe, efficient, affordable, and easy to use.

A compressing device is shown that includes a compression chamber and a plurality of linear drive actuators located along side the compression chamber. The compressing device also includes a ram located within the compression chamber. The ram is coupled to the plurality of linear drive actuators.

A compressing device is also shown that includes a compression chamber and at least one linear drive actuator located along side the compression chamber. The compressing device also includes a ram located within the compression chamber. The ram is coupled to the linear drive actuator. The compressing device also includes a removable workpiece receptacle located within the compression chamber. The workpiece receptacle includes at least a partial sidewall structure.

A compressing device is also shown that includes a compression chamber and a door that accesses the compression chamber. The compressing device also includes at least one crimping portion located within the compression chamber. The compressing device also includes a pair of linear drive actuators located along side the compression chamber. The compressing device also includes a ram located within the compression chamber, where the ram is coupled to the pair of linear drive actuators. The compressing device also includes a removable workpiece receptacle located within the compression chamber, wherein the workpiece receptacle includes a continuous sidewall structure.

These and other embodiments, aspects, advantages, and features of the present invention will be set forth in part in the description which follows, and in part will become apparent to those skilled in the art by reference to the following description of the invention and referenced drawings or by practice of the invention. The aspects, advantages, and features of the invention are realized and attained by means of the instrumentalities, procedures, and combinations particularly pointed out in the appended claims.

DETAILED DESCRIPTION

Figure 1:
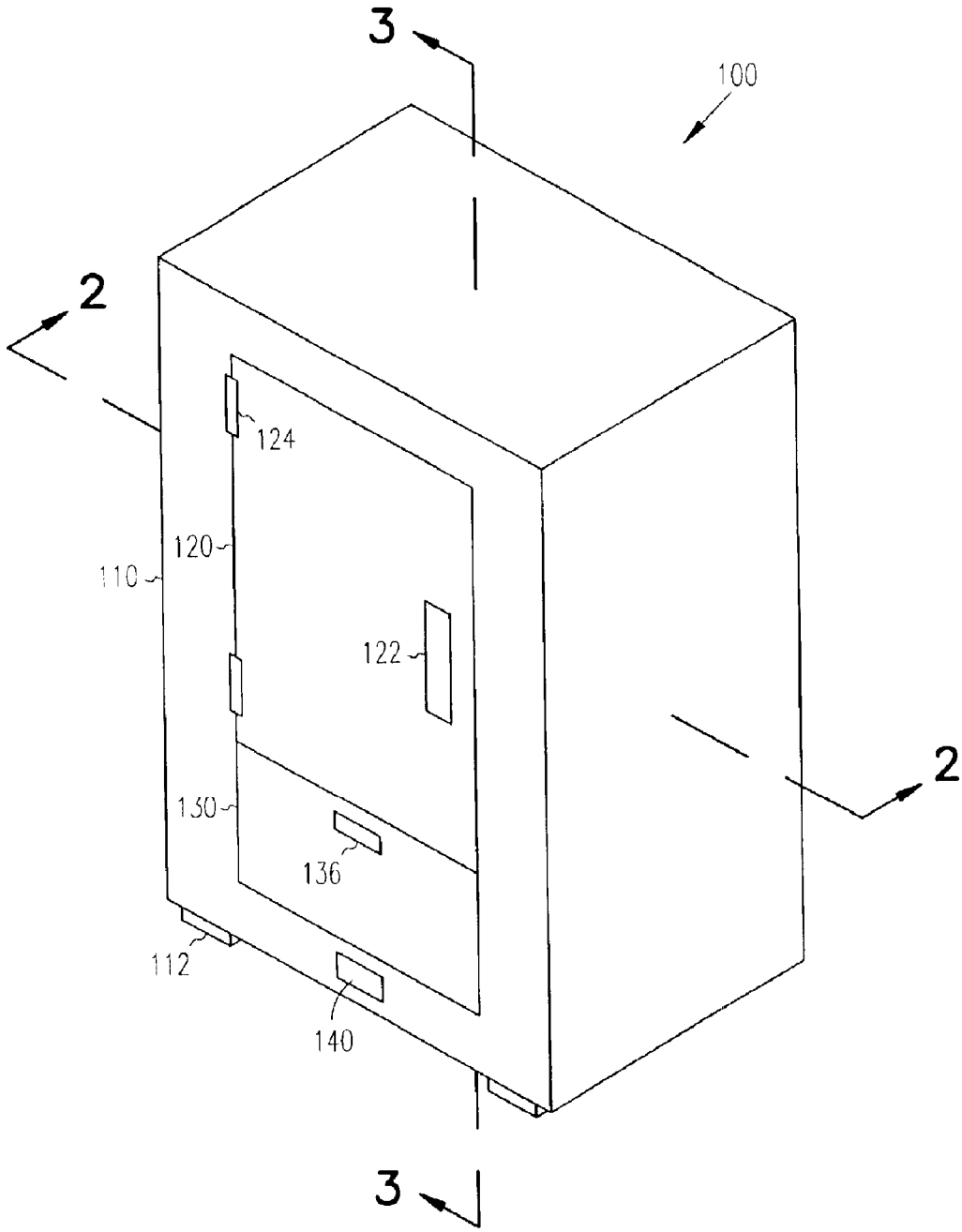
FIG. 1 shows an isometric view of a compressing device according to an embodiment of the invention.

In the following detailed description of the invention, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural changes, logical changes, electrical changes, etc. may be made without departing from the scope of the present invention.

FIG. 1 shows a compressing device 100. The compressing device 100 includes a body 110, a door 120 and a workpiece receptacle 130. In one embodiment, the door includes a handle 122 and a number of hinges 124. In one embodiment, the workpiece receptacle 130 includes a handle 136. Also shown in FIG. 1 is a cycle switch 140. In one embodiment, the cycle switch 140 is actuated to begin a compressing cycle of the device 100. In one embodiment, the compressing device is adapted for crushing cans such as aluminum beverage cans. In one embodiment, a number of resilient pads 112 are included to dampen vibration of the compressing device 100 or to provide a non-slide contact of the compressing device with a surface such as a kitchen counter top. Other embodiments include mounting on a wall or other vertical surface. In a vertical mount embodiment, the resilient pads 112 are mounted on a back of the compressing device 100 to provide a contact with the vertical surface. In one embodiment, the resilient pads 112 include a rubber material.

Figure 2:
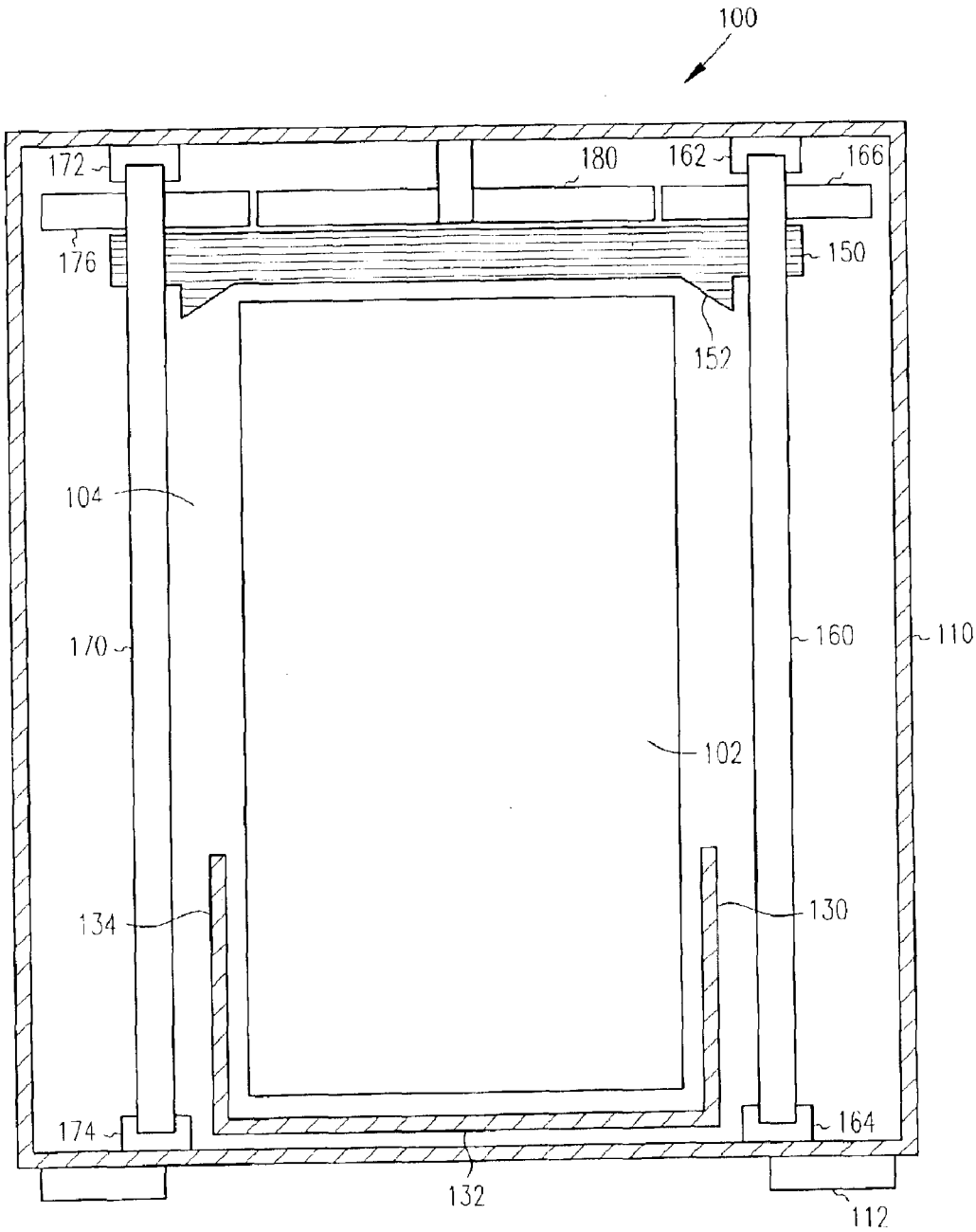
FIG. 2 shows a section view along line 2—2 of a compressing device according to an embodiment of the invention.

FIG. 2 shows a cross section of the compressing device 100 along line 2—2 from FIG. 1. FIG. 2 shows a first linear drive actuator 160 and a second linear drive actuator 170. In one embodiment, the first linear drive actuator 160 and the second linear drive actuator 170 are located along side a compression chamber 104. A workpiece 102 such as an aluminum can or other metal object is shown within the compression chamber 104 in the Figure. A ram 150 is shown coupled to the first linear drive actuator 160 and the second linear drive actuator 170. The ram 150 is positioned over the workpiece 102 such that upon actuation of the first linear drive actuator 160 and the second linear drive actuator 170, the ram 150 will crush the workpiece 102 to a desired height. In one embodiment, the ram 150 further includes a feature 152 to help engage and center the workpiece 102.

In one embodiment, the first linear drive actuator 160 and the second linear drive actuator 170 each include a threaded rod that spins. In one embodiment, the ram 150 engages the threaded rods with mating threads. When the threaded rods of the first linear drive actuator 160 and the second linear drive actuator 170 spin, the ram 150 is driven either up or down depending on the direction of the spinning threaded rods. One suitable type of threaded rod includes ball screw type members.

Although spinning threaded member configurations are shown, the invention is not so limited. Other suitable linear drive actuators include, but are not limited to, hydraulic actuators, other mechanical linkage actuators, etc. Although a pair of linear drive actuators are shown, other numbers of linear drive actuators are also within the scope of the invention. A single linear drive actuator is used in selected embodiments of the invention. In other embodiments of the invention, it is desirable to more equally distribute the compression load of the ram 150 by using two or more linear drive actuators spaced apart from each other along side the compression chamber. In one embodiment, two linear drive actuators are used that are spaced apart substantially on opposite sides of the compression chamber.

By locating a linear drive actuator along side the compression chamber, in contrast to above or below the compression chamber, the overall height and/or size of the compressing device 100 is reduced. It is desirable to minimize the overall height and size of the compressing device to improve the fit of the compression device onto a user surface such as a kitchen countertop. Embodiments using a plurality of linear drive actuators that are located along side a compression chamber are efficient in design by both reducing the overall height and size of the device, and improving compression efficiency by more equally distributing a compressive load.

In one embodiment using spinning rod motion, the first linear drive actuator 160 is supported on a first end by a first bearing 162, and a second end by a second bearing 164. In one embodiment, the second linear drive actuator 170 is supported on a first end by a first bearing 172, and a second end by a second bearing 174. A first gear 166 is shown attached to an upper portion of the first linear drive actuator 160. A second gear 176 is shown attached to an upper portion of the second linear drive actuator 170. A central gear 180 is shown engaging both the first gear 166 and the second gear 176. In this way, rotation of the central gear 180 drives both linear drive actuators 160, 170 in synch with each other.

Also shown in FIG. 2 is a section view of the workpiece receptacle 130. The workpiece receptacle 130 includes a bottom portion 132 and side portions 134. In one embodiment, the bottom portion includes a feature that engages a bottom surface of the body 110 to aid in locating the workpiece receptacle 130. The side portion 134 of the workpiece receptacle 130 helps to guide the workpiece 102 as it is being crushed. In one embodiment, selected regions of the workpiece receptacle 130 include side portions 134 that provide support to the workpiece 102 during crushing. In one embodiment, the workpiece receptacle 130 includes a continuous side portion 134 forming a cup shaped workpiece receptacle 130. A continuous side portion is advantageous because it aids in collecting any remaining liquid that may be present in the workpiece, particularly in the case of an aluminum beverage can.

Figure 3:
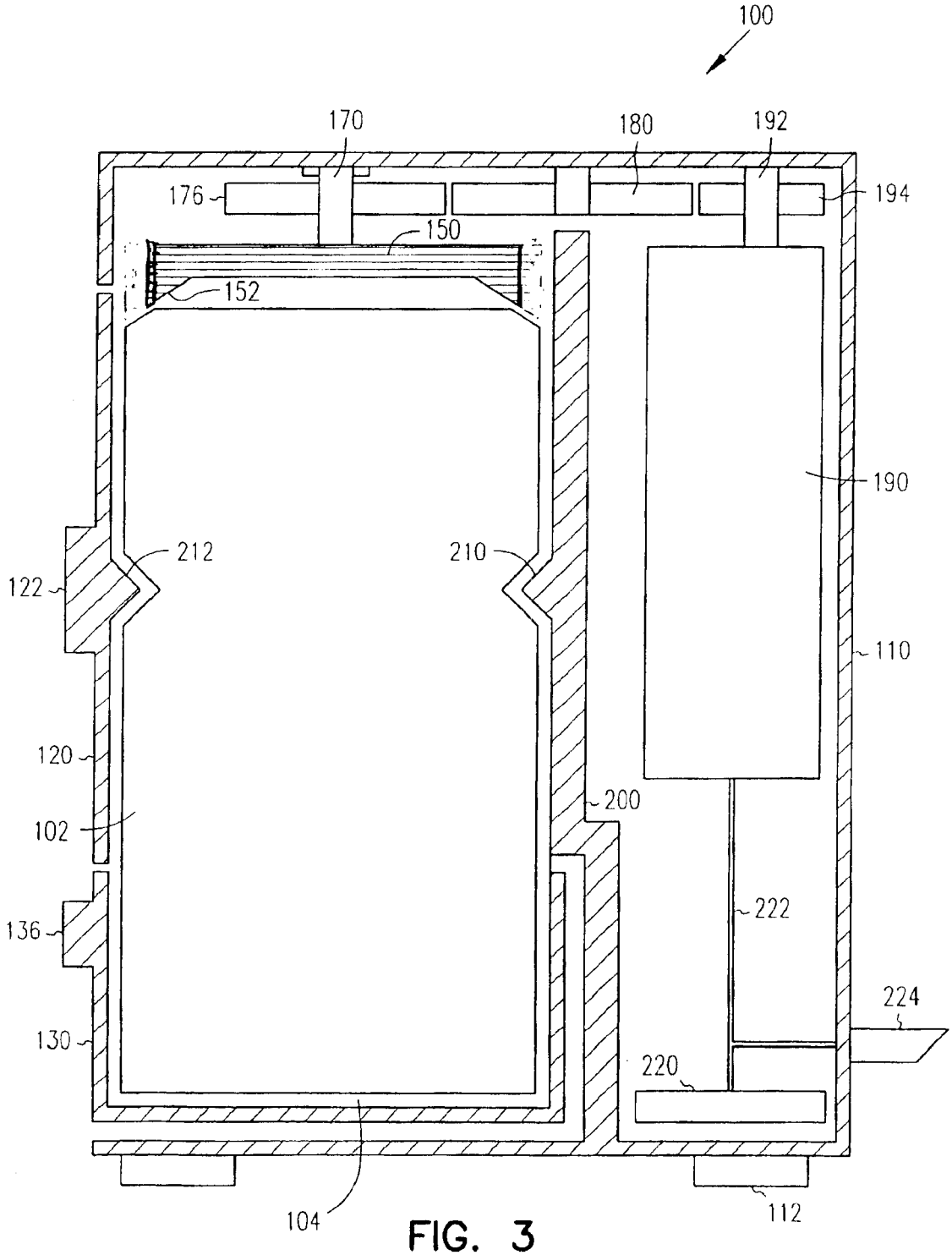
FIG. 3 shows a section view along line 3—3 of a compressing device according to an embodiment of the invention.

FIG. 3 shows another sectional view of the compressing device 100 along line 3—3 from FIG. 1. A power unit 190 is shown in FIG. 3 within the body 110 of the compressing device 100. In one embodiment, the power unit 190 includes an electric motor. The power unit 190 is in communication with the linear drive actuators shown in FIG. 2. In one embodiment, gears are used to place the power unit 190 in communication with the linear drive actuators. Other possible linkages include belt drive, chain drive, etc. In FIG. 3, a drive shaft 192 is shown, with a drive gear 194 attached to an end of the drive shaft 192. In one embodiment, the drive gear 194 engages the central gear 180, that in turn drives the first gear 166 and the second gear 176.

An isolation wall 200 is also shown in FIG. 3 between the compression chamber 104 and the back side of the compressing device 100. The isolation wall prevents liquid or other debris from contaminating the back portion of the compressing device 100, where the power unit 190 and other circuitry are housed.

Also shown in FIG. 3 is a first crimping portion 210 and a second crimping portion 212. In one embodiment, the first crimping portion 210 is located on a back wall of the compression chamber 104. In one embodiment, the second crimping portion 212 is located on the door 120. Although a pair of crimping portions are shown, other embodiments include only a single crimping portion, or more than two crimping portions. As can be seen from the Figure, the crimping portions 210 and 212 crimp selected side regions of the workpiece 102, thus making the crushing operation easier and more controlled.

An operation circuit 220 is also shown in FIG. 3. The operation circuit 220 is coupled to the power unit 190 using connection lines 222 such as wires. In one embodiment, the connection lines 222 are further connected to an external power cord such as an AC power cord 224. In one embodiment, the operation circuit 220 includes devices such as switches, a printed logic circuit, etc. for operation of the compressing device 100. The isolation wall 200 also serves to protect the operation circuit 220 from liquid or debris contamination.

Figure 4:
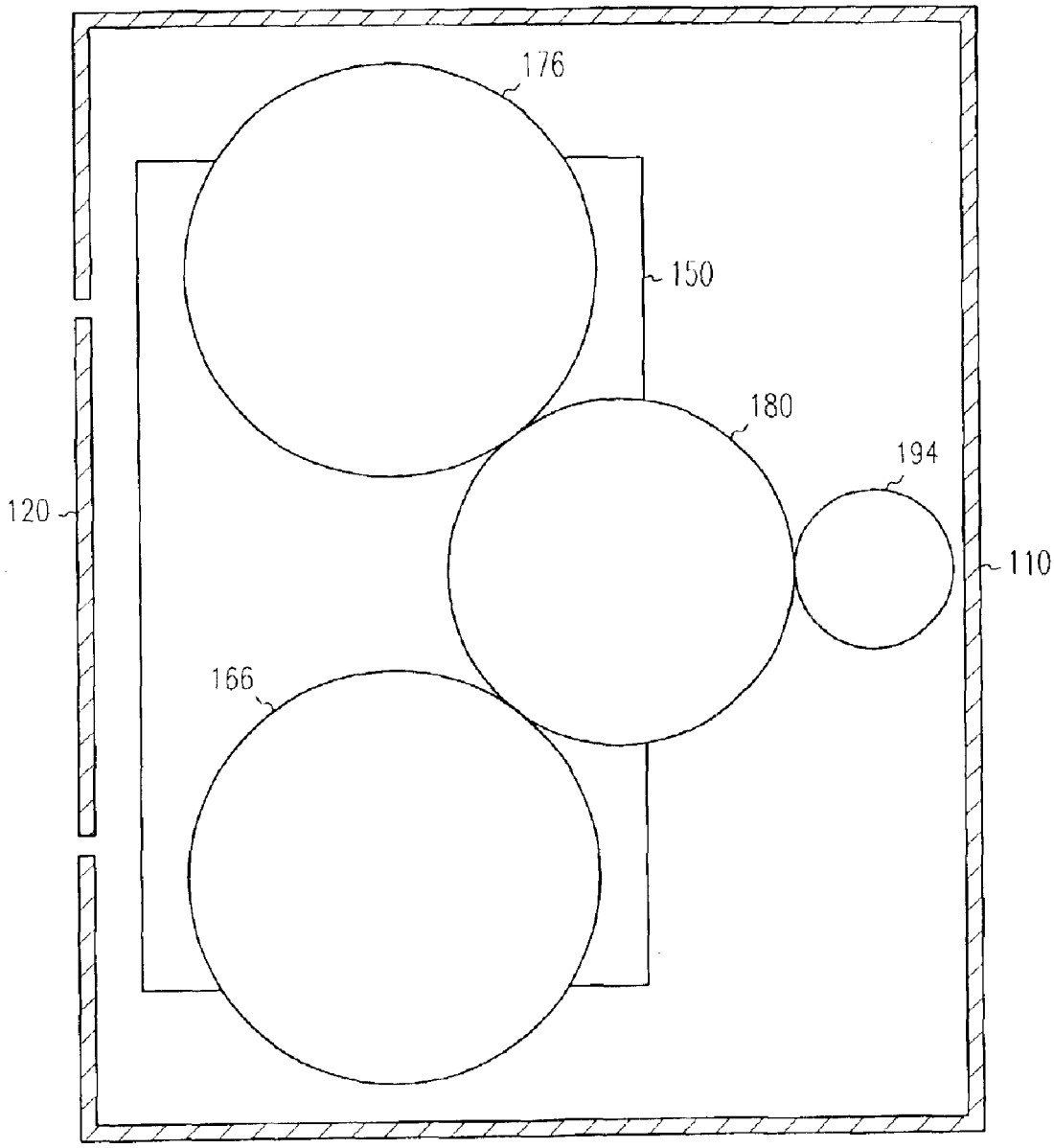
FIG. 4 shows a cut away top view of a compressing device according to an embodiment of the invention.

FIG. 4 shows a top view of the compressing device 100. The ram 150 is shown, along with the first gear 166, the second gear 176, the central gear 180 and the drive gear 194. Although certain numbers of gears, gear sizes, etc. are shown, the invention is not so limited. A number of gear combinations, ratios, and resulting mechanical advantages are possible within the scope of the invention.

Figure 5:
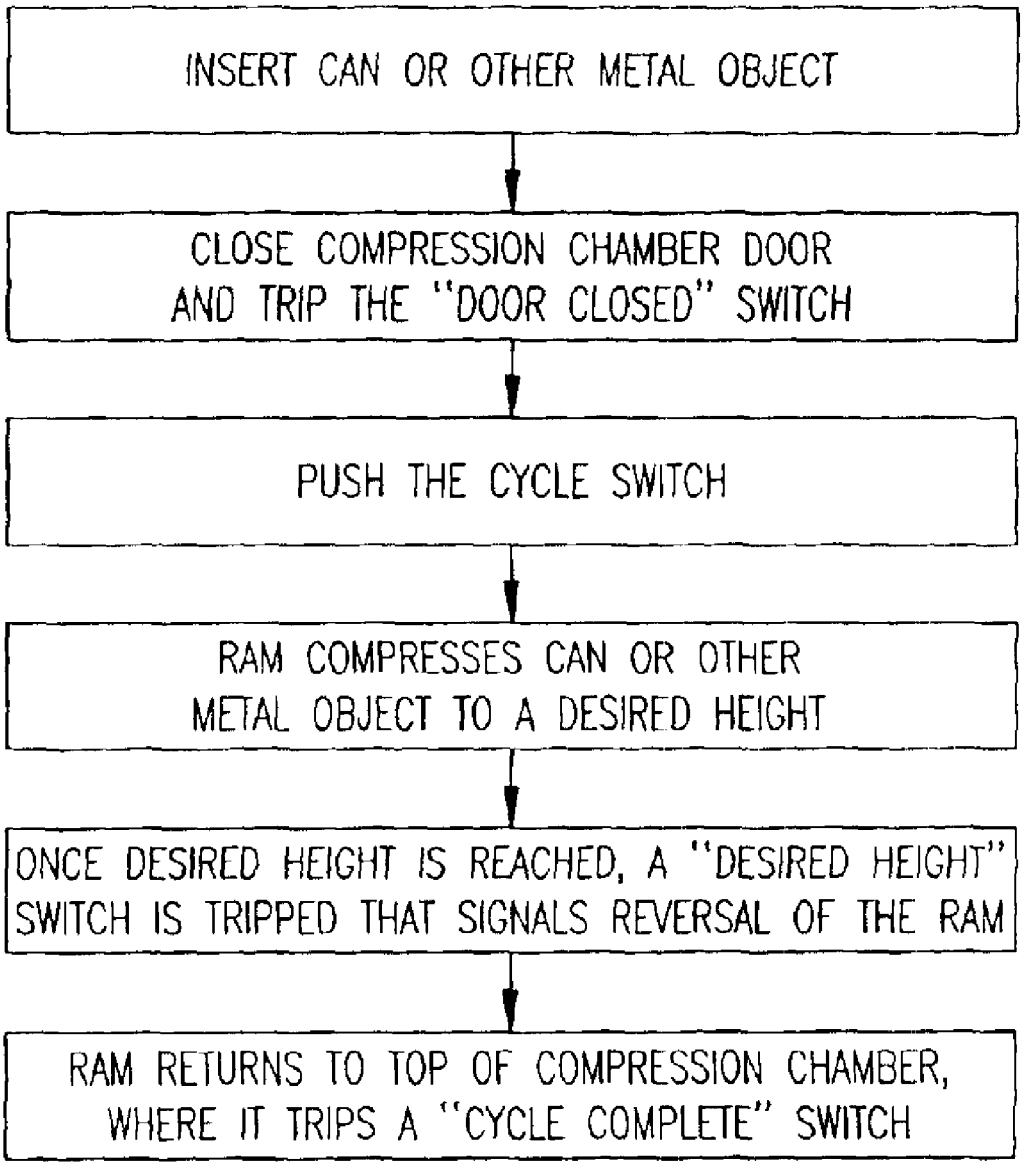
FIG. 5 shows a flow diagram of a method of compressing an object according to an embodiment of the invention.

FIG. 5 shows one embodiment of a method of operation of a compressing device according to embodiments described above. The door is opened, and a can or other workpiece is inserted into the compression chamber. The door is then closed. In one embodiment, a switch is actuated that sends a message to the operation circuit 220 indicating that the door is closed. The use of the switch improves device safety by shutting down the device if the door is opened, and not allowing the device to begin a compression cycle if the door is not first closed.

The cycle switch is actuated to begin the compression cycle where the ram is driven downwards by the linear drive actuators. The can or other workpiece is then crushed into the workpiece receptacle to a desired height. In one embodiment, the can or other workpiece is crushed to a height of 1½ to 1¾ inches. During the crushing operation, the can is guided by the side portions of the workpiece receptacle. Any remaining liquid or other debris is collected within the workpiece receptacle.

At the bottom of the ram stroke, another switch is actuated to reverse direction of the linear drive actuators. Once the ram reaches a full "up" position, a third switch is actuated to indicate that the crushing cycle is complete. In one embodiment, an additional switch is included to shut off the device if a "jam" occurs. Such a switch may monitor crushing force, and shut off the device if a high force threshold is exceeded.

After the crushing cycle is complete, the workpiece receptacle is removed from the compressing device and the crushed workpiece is dumped into a storage bin. The sides of the workpiece receptacle further provide a safety feature, where any sharp edges generated on the workpiece during the crushing operation are protected within the sidewall portions. In one embodiment, the workpiece receptacle is then washed before being placed back in the compressing device. In one embodiment, the workpiece receptacle is manufactured from a material that is dishwasher safe, such as a plastic material. The removability of the workpiece receptacle increases the safety features as described above, and allows the workpiece receptacle to be inserted separately into a dishwasher.

CONCLUSION

Thus has been shown a compressing device that is suitable for crushing cans. Embodiments described above include a plurality of linear drive actuators located along side a compression chamber to both reduce height/size of the compressing device, and provide a more uniform compression force to the can.

Embodiments as described above include a workpiece receptacle that collects liquid or other debris, increases the safety of the compressing device by shielding sharp edges of the crushed workpiece, and provides for easy cleaning due to it's removability and dishwasher safe construction.

Embodiments as described above include crimping portions that provide more controlled easier crushing of work pieces such as aluminum cans.

Although specific embodiments have been illustrated and described herein, it will be appreciated by those of ordinary skill in the art, with the benefit of having read the present specification, that any arrangement which is calculated to achieve the same purpose may be substituted for the specific embodiment shown. This application is intended to cover any adaptations or variations of the present invention. It is to be understood that the above description is intended to be illustrative, and not restrictive. Combinations of the above embodiments, and other embodiments will be apparent to those of skill in the art upon reviewing the above description. The scope of the invention includes any other applications in which the above structures and fabrication methods are used. The scope of the invention should be determined with reference to the appended claims, along with the full scope of equivalents to which such claims are entitled.

What is claimed is:

1. A compressing device, comprising:

a compression chamber sized to accept a single can;

at least one side crimping portion located within the compression chamber and directly attached to a wall of the compression chamber;

a plurality of linear drive actuators located along side the compression chamber;

a ram located within the compression chamber, and coupled to the plurality of linear drive actuators.

2. The compressing device of claim 1, wherein the plurality of linear drive actuators includes two linear drive actuators spaced substantially opposite each other on opposite sides of the compression chamber.

3. The compressing device of claim 1, further including an electric motor located along side the compression chamber, and coupled to the plurality of linear drive actuators.

4. The compressing device of claim 1, wherein the plurality of linear drive actuators includes a plurality of ball screw actuators.

5. The compressing device of claim 3, wherein the electric motor is coupled to the plurality of linear drive actuators using at least one toothed gear.

6. A compressing device, comprising:

a compression chamber;

at least one crimping portion located within the compression chamber and directly attached to a wall of the compression chamber;

at least one linear drive actuator located along side the compression chamber;

a ram located within the compression chamber, and coupled to the linear drive actuator;

a removable workpiece receptacle located within the compression chamber, wherein the workpiece receptacle includes at least a partial sidewall structure.

7. The compressing device of claim 6, wherein the at least one linear drive actuator includes a plurality of linear drive actuators.

8. The compressing device of claim 6, further including an electric motor located along side the compression chamber, and coupled to the at least one linear drive actuator.

9. The compressing device of claim 6, wherein the at least one linear drive actuator includes at least one ball screw actuator.

10. The compressing device of claim 8, further including includes a liquid isolation barrier between the electric motor and the compression chamber.

11. The compressing device of claim 6, wherein the partial sidewall structure includes a continuous sidewall structure.

12. The compressing device of claim 6, wherein the workpiece receptacle is made from a material that is dishwasher safe.

13. A compressing device, comprising:

a compression chamber;

a door that accesses the compression chamber;

at least one crimping portion located within the compression chamber and directly attached to a wall of the compression chamber;

a pair of linear drive actuators located along side the compression chamber;

a ram located within the compression chamber, and coupled to the pair of linear drive actuators;

a removable workpiece receptacle located within the compression chamber, wherein the workpiece receptacle includes a continuous sidewall structure.

14. The compressing device of claim 13, wherein the at least one crimping portion is located on the inside of the door.

15. The compressing device of claim 14, wherein a second crimping portion is located on a side portion of the compression chamber.

16. The compressing device of claim 13, further including a switch that is actuated when the door is closed on the compression chamber, wherein the compressing device will only compress an object with the door closed.

17. A compressing device, comprising:

a compression chamber sized to accept a single can;

at least a pair of crimping portions located within the compression chamber and directly attached to a wall of the compression chamber;

a plurality of linear drive actuators located along side the compression chamber;

a ram located within the compression chamber, and coupled to the plurality of linear drive actuators.

* * * * *